United States Patent [19]

Bowman

[11] Patent Number: 4,771,557

[45] Date of Patent: Sep. 20, 1988

[54] TRANSPARENT POCKET FOR MOUNTING DISPLAY ITEMS AND METHOD FOR MANUFACTURING SAME

[75] Inventor: Robert G. Bowman, Darien, Conn.

[73] Assignee: C.R. Gibson Company, Norwalk, Conn.

[21] Appl. No.: 15,212

[22] Filed: Feb. 13, 1987

Related U.S. Application Data

[63] Continuation-in-part of Ser. No. 756,598, Jul. 19, 1985, abandoned.

[51] Int. Cl.[4] ..... A47G 1/06; G09F 1/12

[52] U.S. Cl. ..... 40/158.1; 40/661; 40/159; 40/594

[58] Field of Search ..... 40/10 D, 159, 10 R, 40/158 A, 158 R, 594, 595; 248/467; 156/217; 206/819; 220/470, 902; 428/128, 469

[56] References Cited

U.S. PATENT DOCUMENTS

| | | | |
|---|---|---|---|
| 1,956,527 | 4/1934 | De Groot | 40/10 D |
| 2,169,290 | 8/1939 | Rossi | 40/159 |
| 2,611,369 | 9/1952 | Herrick | 40/159 |
| 2,699,103 | 1/1955 | Stasikewich | 40/594 |
| 2,925,675 | 2/1960 | Lumpkin | 40/10 D |
| 3,440,750 | 4/1969 | Toth et al. | 40/158 R |
| 3,687,770 | 5/1970 | Chase | 40/158 R |
| 3,943,645 | 3/1976 | Viestors | 40/10 D |
| 4,019,943 | 4/1977 | Holson | 40/158 R |
| 4,648,546 | 7/1954 | Morton | 40/159 |

FOREIGN PATENT DOCUMENTS

| | | | |
|---|---|---|---|
| 2018996 | 11/1971 | Fed. Rep. of Germany | 248/467 |
| 67120 | 9/1913 | Switzerland | 40/159 |

*Primary Examiner*—Robert Peshock
*Assistant Examiner*—J. Hakomaki
*Attorney, Agent, or Firm*—Grimes & Battersby

[57] ABSTRACT

A system is provided for mounting a flat, display item such as a photograph, on a surface such as the pages of an album, a book, a report, or any other substrate. The system includes a one-piece, transparent pocket folded to define an upper display surface and an opposed lower surface. The pocket is open along at least one side edge to permit insertion of the item between the opposed surfaces. A layer of adhesive material is provided over substantially the entire lower surface of the pocket for adhesively mounting the pocket to the surface. The adhesive material, preferably a thermoplastic, pressure sensitive, medium tack adhesive, is initially releasable but after a period of time, forms a permanent bond between the pocket and the surface.

An album for displaying such flat, display items is further provided. The album includes a plurality of pages for mounting the display items and a plurality of these one-piece pockets.

A method for manufacturing a plurality of these one-piece pockets is still further provided. The method comprises the steps of providing a continuous web of transparent material; applying a continuous line of adhesive material to the web; folding the web along upper and lower fold lines to form a continuous sleeve; sealing the sleeve along the continuous line of adhesive and laminating to one surface thereof a web of release paper which has been coated with a second adhesive; and cutting the laminated sleeve in predeterminated locations to form a plurality of the pockets.

13 Claims, 2 Drawing Sheets

TRANSPARENT POCKET FOR MOUNTING DISPLAY ITEMS AND METHOD FOR MANUFACTURING SAME

RELATED APPLICATION

This is a continuation in part application of U.S. patent application, Ser. No. 756,598 filed on July 19, 1985 in the name of Robert G. Bowman for Transparent Pocket for Mounting Display Items and Method for Manufacturing Same, now abandoned.

BACKGROUND OF THE INVENTION

1. Field of the Invention

The present invention relates generally to a transparent pocket for mounting display items such as, for example, photographs in an album and a method for manufacturing same and, more particularly, to such a transparent mounting pocket which can, at first, be releasably mounted on an album page but which will, after a period of time, become permanently bonded to that page. The invention further comprises a photo album adapted to utilize these transparent pockets for mounting photographs therein.

2. Description of the Prior Art

Heretofore, display items such as, for example, photographs, have been mounted in albums in a variety of different ways. For example, early photo albums simply comprised a bound book of relatively stiff pages to which photographs were pasted or otherwise affixed in an unprotected state. It was discovered, however, that when photographs were merely pasted or glued into such albums, they often deteriorated because of prolonged exposure to the atmosphere. Moreover, these photographs could soon become distorted and possibly crack due to the hardening of the paste or glue used to affix them to the page.

More recent types of photo albums employ an overlay sheet of a transparent plastic film which serves to not only secure the photographs to the underlying album page but, in addition, protects the photographs from deterioration since it protects them from constant exposure to the atmosphere. An example of such a photo album is described in U.S. Pat. No. 4,019,943 which issued on April 26, 1977 for Photographic Album Page and Method of Making Same. It will be appreciated, however, that photo albums of this type fail to fully protect the photographs from the surrounding atmosphere since a complete atmospheric seal is not provided around the photographs.

Other types of photo albums which are commonly used are bound volumes of multiple transparent envelopes or pockets into which individual photographs may be inserted. There is no flexibility for the re-orientation of the photographs in such albums once the photographs are placed in the pocket nor are these albums able to accommodate photographs of different sizes and shapes.

The present invention contemplates a photo album which utilizes a plurality of transparent pockets into which individual photographs may be inserted. The pockets are adhesively mounted onto the pages of the photo album using an adhesive material which is contained on the back or lower surface of the pocket. The adhesive material used to mount these pockets on the album pages is, at first, releasable; however, after a period of time, such adhesive material will form a permanent bond between the transparent pocket and the album page. The use of such an adhesive material permits the user, after a period of time, to be able to reposition the pockets on the album page to insure proper or desired orientation and location relative to other photographs on the page. After the period of time, however, the adhesive bond strength increases, thereby permanently bonding the pocket to the album page. The ability to effect a permanent bond between the photograph containing pocket and the album page is particularly important to prevent loss of any photograph mounted in such fashion.

It has been found, in particular, that when a thermoplastic, pressure sensitive, adhesive is used for both forming the pocket and for adhering the pocket to an album page, substantial advantages are achieved. Such an adhesive has a substantially higher bond strength to the transparent film than other adhesives. Also, such an adhesive can be applied in much thinner, more uniform coatings than other adhesives. Since the coating is very thin and uniform, it has a high resistance to shearing stresses. This resistance to shear creates a high strength bond in the film to film adhesive used in forming the pocket.

Attempts have been made in the past to provide transparent pockets for use in mounting display items on album pages or the like. Examples of such attempts include, for example, U.S. Pat. No. 2,152,881 which issued on April 4, 1939 to Albert W. Engel for Transparent Mounting Device; U.S. Pat. No. 2,611,369, which issued to Robert E. Herrick on Sept. 23, 1952 for Album Photo Holder or Mounting; and U.S. Pat. No. 3,893,252, which issued to Marston Chase on July 8, 1975 for an Adhesive Picture Mount.

All of the above described transparent pockets lack the simplicity of construction of the present transparent pocket which permits manufacture in commercial quantities at a reasonable price. More importantly, none of these prior art pockets could be, for an initial period of time, repeatedly repositioned in the album and, then, become permanently bonded to the album page after a longer period.

SUMMARY OF THE INVENTION

Against the foregoing background, it is a primary object of the present invention to provide a transparent pocket which is adapted to be used for mounting display items such as, for example, photographs on virtually any type of surface.

It is another object of the present invention to provide such a transparent pocket which may be adhesively bonded to album pages, books, reports or the like.

It is still another object of the present invention to provide such a transparent pocket adapted to, at first, be releasably mounted on the surface to permit desired orientation and location of the pocket but, thereafter, become permanently bonded thereto.

It is still yet another object of the present invention to provide a photograph album which includes a plurality of album pages and a plurality of transparent pockets which may be, at first, releasably mounted on such pages but which will, thereafter, become permanently bonded thereto.

It is yet still another object of the present invention to provide a method for manufacturing such transparent pockets.

To the accomplishments of the foregoing objects and advantages, the present invention, in brief summary, comprises a system for mounting a flat, display item such as, for example, a photograph on a surface such as a page of an album. The system of the present invention includes a one-piece, transparent pocket folded in such a manner so as to define an upper display surface and an opposed lower surface. The pocket is open along at least one edge to permit insertion of the display item between the opposed surfaces. A layer of adhesive material is provided over substantially the entire lower or rear surface of the pocket for adhesively mounting the pocket to the surface. The adhesive material, preferably a thermoplastic pressure sensitive, medium tack adhesive, is initially releasable but, after a period of time, forms a permanent bond between the pocket and the surface. A stiffening insert is preferably provided within the pocket. Preferred stiffening inserts include, for example, paper. Additionally, cardboard, bristol board or the like may be used.

An album for displaying such flat, display items is further provided. The album includes a plurality of pages for mounting the display items and a plurality of such one-piece pockets.

A method for manufacturing a plurality of these one-piece pockets is still further provided. The method comprises the steps of providing a continuous web of transparent material; applying a continuous line of permanent adhesive material to the web; folding the web along upper and lower folds to form a continuous sleeve; sealing the sleeve along the continuous line of adhesive and laminating to one surface thereof a web of release paper which has been coated with a second, initially releasable adhesive; and cutting the laminated sleeve in predeterminated locations to form a plurality of such pockets.

BRIEF DESCRIPTION OF THE DRAWINGS

The foregoing and still other objects and advantages of the present invention will be more apparent from the following detailed explanation of the preferred embodiments of the invention in connection with the accompanying drawings wherein.

DESCRIPTION OF THE PREFERRED EMBODIMENTS

Figure 1:
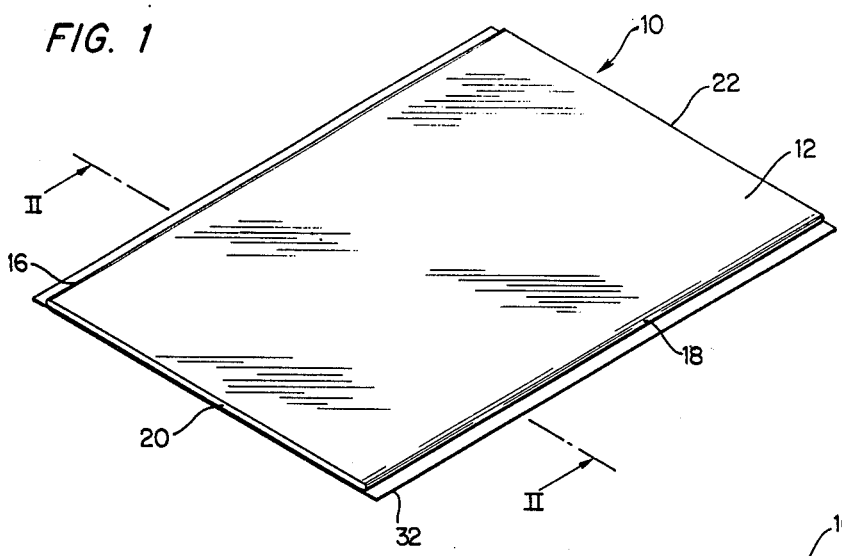
FIG. 1 is a perspective illustration of the transparent photograph mounting pocket of the present invention.
Figure 3:
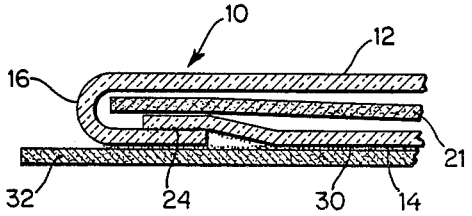
FIG. 3 is an enlarged end view of the mounting pocket of FIG. 1.
Figure 2:
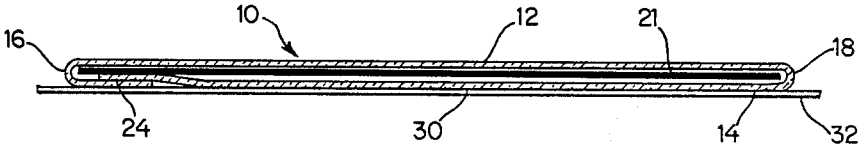
FIG. 2 is a section view taken along lines II—II of FIG. 1.

The mounting pocket of the present invention, referred to generally by reference numeral 10, is illustrated in FIGS. 1–3. The mounting pocket 10 is formed from a single sheet of transparent film material such as, for example, polyester, polyvinyl chloride or polypropylene. A particularly preferred transparent material is biaxially oriented polypropylene (BOPP) film, preferably with a thickness of between approximately 0.001 and approximately 0.003 inches. It has been found that BOPP film is especially compatible with most photographic prints and will not react with or otherwise degrade the pictures. A prferred thickness of the transparent material used in fabricating the mounting pocket 10 is approximately 0.002 inches.

As shown in FIG. 1, the mounting pocket 10 is formed by folding a continuous piece of transparent material along upper and lower folds 16 and 18, respectively, thereby defining a pocket 10 having an upper surface 12 and an opposed lower surface 14. The ends of the continuous piece of transparent material are sealed at seal 24 to complete the pocket 10. Edges 20 and 22 are open to permit insertion and removal of a photograph or other item to be displayed between the upper and lower surfaces 12 and 14. A stiffening insert 21 is provided within the pocket 10. Stiffening insert 21 is preferably fabricated from paper and serves to provide a degree of stiffness to the pocket when not containing a photograph or other display item. The stiffening insert 21 renders the pocket 10 easier to be placed and, if necessary, relocated, on a substrate, particularly in the absence of a photograph or other display item.

The seal 24 can be effected by the use of any suitable adhesive material. Preferred adhesive materials include pressure sensitive synthetic adhesives as well as heat actuated, synthetic adhesives. A particularly preferred adhesive is a thermoplastic, pressure sensitive, adhesive with high tack strength, compounded from paraffin wax and synthetic resins such as, for example, the thermoplastic, pressure sensitive adhesive marketed by Swift Adhesives Division of Reichhold Chemicals, Incorporated of Downers Grove, IL which is designated as Product No. 83056. Another type of adhesive material which could be used for effecting seal 24 is a thermoplastic, non-pressure sensitive, heat reactivatable adhesive.

The thermoplastic material used for effecting seal 24 should have a relatively high peel strength, preferably with a minimum 180° peel strength of 6 lbs. minimum/inch of width at 70° F. and a minimum shear creep of 10,000 minutes under a load of 1000 g/in2 at 70° F. It will be appreciated that the seal 24 is particularly vulnerable to breakage since it is oftentimes highly stressed during the introduction of a photograph within the pocket 10. Accordingly, it is extremely important that the seal 24 be made with an adhesive having a high peel strength, and shear strength.

The pocket 10 must be of sufficient size to permit relatively easy insertion and removal of a photograph or display item between its upper and lower surfaces 12 and 14 but must still be able to tightly retain the photograph or other item therein by simple surface friction. For example, when the item to be mounted in the pocket 10 is a photograph, two photograph sizes for the pockets 10 may be $3\frac{1}{2}'' \times 5''$ or $4'' \times 6''$. It will, of course, be appreciated that the pocket can be fabricated in virtually any size to accommodate a particular display item. Due to the nature of the pocket 10, it completely envelops the photograph or other display item and, due to the transparent nature thereof, permits viewing of the item yet provides protection therefore from outside elements.

By completely enveloping the photograph, the pocket 10 protects the photograph from outside elements thereby providing protection against abrasion and contact with a user's skin or the opposite page of the album. Similarly, since the pocket is substantially transparent, it provides protection for the photograph without limiting the viewable area thereof.

It will, of course, be appreciated that although the mounting pocket 10 of the present invention is primarily intended to be used for mounting photographs in photo albums or the like, it can also be used for the mounting and display of other types of flat items such as, for example, postage stamps, art prints and the like.

The pocket 10 is adapted to be mounted on surfaces such as, for example, album pages or the like by the use of a layer 30 of an adhesive material which is provided over substantially all of lower surface 14. A protective layer 32 of release paper or the like is further provided over the adhesive material to cover the adhesive material until the pocket is ready to be mounted.

The adhesive material used in the adhesive layer 30 is of a type which is releasable upon initial mounting of the pocket 10 in order to permit location and placement of the pocket 10 on the album page. After sufficient contact time between the adhesive and the page, a permanent bond is thereupon effected between the pocket 10 and the album page. An adhesive which immediately creates a permanent bond between the pocket 10 and the album page would be unacceptable since it would prevent relocation or re-orientation of the pocket 10 and the photograph contained therein on the album page. Similarly, an adhesive which is permanently releasable would, likewise, be unacceptable since it would prevent permanent mounting of the pockets 10 and the photographs contained therein on the album page.

A preferred type of adhesive material for use in adhesive layer 30 is a thermoplastic, pressure sensitive adhesive with medium tack strength compounded from paraffin wax and synthetic resins such as, for example, the thermoplastic, pressure sensitive adhesive material marketed by Malcolm Nichol and Company, Incorporated of Lyndhurst, N.J. which is designated as Nicolmelt P1598. Such a thermoplastic pressure sensitive adhesive possesses the following physical properties:

Viscosity at 350° F.: 10,000 cps
Specific Gravity: 0.95
Application Temperature: 325° F.
Adhesive Film Thickness: Very uniform and controllable when extruded at about 0.0008"
180° peel strength: 1 lb min–1.5 lb. max/inch in width at 70° F.
Shear creep: 15 hours minimum/20 hours maximum at 500 g load and at 1 square inch of surface area.

It will be appreciated that the above numbers relative to peel strength and shear creep are initial values only and will increase substantially over time.

It has been found that thermoplastic, pressure sensitive, medium tack adhesives are releasable for relatively short periods of time after initial mounting, i.e., generally less than about 24 hours, but will, thereafter, effect a permanent bond with the album page. The significant initial period of releasability permits the user a reasonable amount of time to be able to initially relocate and re-orient the pockets 10 on the album page without causing any damage to either the pocket 10 or the album page; however, after a prolonged period of time, i.e., about 24 hours, a permanent bond is effected between the pocket 10 and the album page. This permanent bond is effected by migration or creeping of the thermoplastic, pressure sensitive, adhesive compounds into the fibers of the underlying paper of the album pages.

The use of such adhesive material offers numerous advantages. Due to its high peel strength, the adhesive can be applied as a thinner, more uniform, coating. For example, such adhesives may be applied in thickness between 0.0008" and 0.0009". It has also been found that such thermoplastic adhesives achieve a greater adhesion to the pocket 10 thereby permitting re-orientation without any adhesive material being left behind on the page as was the case with other types of adhesives heretofore used.

Figure 4:
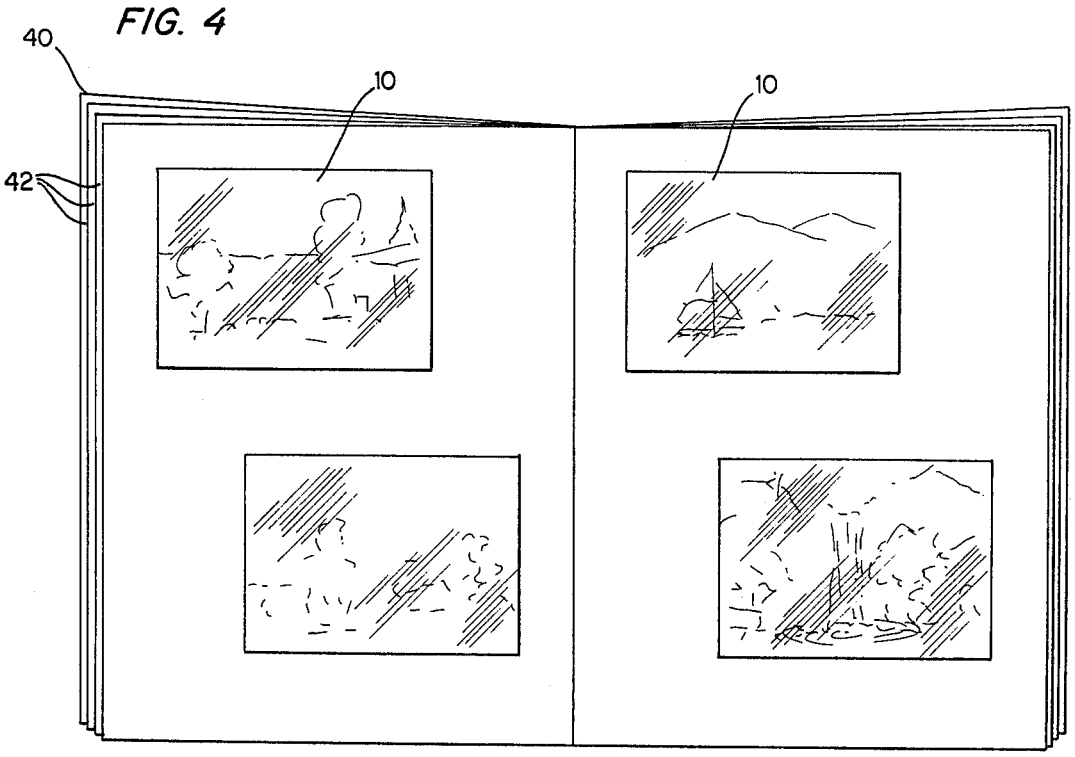
FIG. 4 is a front view of a photo album which contains a urality of photographs which are mounted on album pages using the mounting pockets of FIG. 1.

FIG. 4 illustrates a photo album 40 of the type which includes a group of individual pages 42 to which individual photograph containing pockets 10 may be bonded in virtually any desired arrangement. It will be appreciated that the photograph containing pockets 10 may be mounted in virtually any desired position on the pages 42.

In order to mount a photograph in such a photo album 40, the photograph is first inserted through one of the open ends 20, 22 into the pocket 10 between the upper surface 12 and the stiffening insert 21. The photograph is visible through the transparent upper surface 12 of the pocket 10. The protective release paper layer 32 is then removed which exposes the adhesive in the adhesive layer 30. The pocket 10 may then be positioned in the desired location on the album page 42 and mounted thereon.

Since the adhesive material used in the adhesive layer 30 is initially releasable, the photograph contained within the pocket 10 can be repositioned, realigned and re-oriented until a desired position is achieved without any damage, whatsoever, to the pocket 10 or the album page 42. After a sufficient period of time, however, a permanent bond is created between the pocket 10 and the underlying album page 42 as the adhesive material migrates or creeps into the paper of the album page 42, thereby preventing removal and relocation of the pocket 10.

Figure 5:
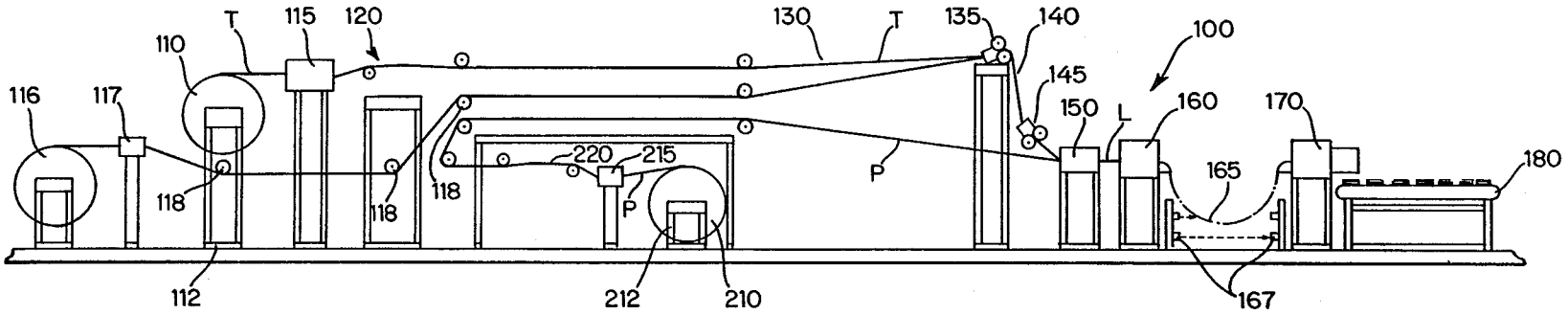
FIG. 5 schematically illustrates the method of manufacturing the transparent pockets of FIGS. 1–3.

The method for fabricating the pockets 10 of the present invention is described schematically in FIG. 5. In accordance with this method, apparatus 100 is provided for initially forming the pocket 10 by a sheet of transparent material in such a manner so as to first form the pocket 10. The initially releasable adhesive material is then applied to the protective layer of release paper 32 which is then laminated to the continuous sleeve of transparent material 10. The laminated pockets 10 with the protective layer of release paper are then cut to size and stacked for packaging.

The pockets 10 of the present invention are formed in the following manner. A continuous roll of transparent material 110 is provided at the first payoff stand 112. The web T of transparent material 110 is then passed through a bridle roll stand with film crease scorer 115 where the web T is tensioned and creased at the locations of the eventual upper and lower folds 16 and 18, respectively. The crease score rolls are heated to about 350° F. to cause permanent crease scores to be formed in the transparent material web.

The creased web T is then placed in contact with an extrusion coating device which applies the hot thermoplastic, pressure sensitive adhesive, thin coating to the bottom surface of the running web T.

The emerging web T is then folded substantially in half in a helical manner at a first folding station 130 to form the outline of the pocket 10. This fold is made along what will then become the lower fold 18 of the pocket 10. Thereafter, the folded web T passes through a first film edge heat and iron stand 135 where the edge of the film web T is heated and the fold is ironed smooth. A second shorter fold is then made in the running web T in an helical fashion at second folding station 140. This second fold is made along what will become the upper fold 16 of the pocket 10. The now twice-folded web T then passes through a second film edge heat and iron stand 145 where the other edge of the film web T is again heated and the second fold is ironed smooth. Seal 24, which closes the pocket 10, is effected at this station. The resultant web T is now in the shape of a sleeve as it enters a lamination station 150.

Simultaneously with the processing of the web T, a second web P of release paper with one side coated with a release material such as silicone, is processed for eventual joining with and lamination to the web T of the transparent material. In this second simultaneous processing operation, a roll of release paper 210 is provided on a release paper payoff stand 212. The web P thereafter passes from the payoff stand 212 through bridle roll stand 215 where proper tension is achieved. The hot, thermoplastic, pressure sensitive material which will form the adhesive layer is then applied along the underside of the web P by an extrusion coating device.

A third simultaneous processing operation is used to insert the stiffening inserts 21 into the pockets 10. A roll of cardboard or paper 116 is provided for use in supplying the stiffening inserts 21. The paper travels off the roll 116, passes through a bridle roll stand 117, passes around a pair of rollers 118 and is joined with the web T prior to the first film edge heat and iron stand 135.

At laminating station 150, web P of release paper is brought into contact with the web T of transparent material and they are joined by the action of the adhesive material which had been applied to the web P of release paper at coating station 220.

The laminated webs L are then played through a web drive 160 which includes tractor means for pulling the webs through the apparatus 100. As the web L emerges from the web drive 160, a loop 165 is formed in the web L prior to its introduction into an intermittent feed cutoff/stacker 170. Two pair of photo-electric controls 167 are provided which determine the amount of loop 165 prior to the cutoff/stacker 170. The loop 165 isolates the intermittent speed of the cutoff "feed-stop-cut" action from the constant speed required at the web drive 160. The web L is then cut into predetermined sizes in the cutoff/stacker 170 and delivered and stacked on delivery conveyor 180 for subsequent processing.

Having thus described the invention with particular reference to the preferred forms thereof, it will be obvious that various changes and modifications may be made therein without departing from the spirit and scope of the invention as defined by the appended claims.

Wherefore, I claim:

1. A system for mounting a flat, display item on a substrate, said system including:

a one-piece pocket formed from a single sheet of transparent film material and folded to define an upper display surface for permitting viewing of the display item while projecting same and an opposed lower surface, said pocket being open along at least one side edge thereof to permit insertion and complete enveloping of the item between said opposed upper and lower surfaces, said film material selected from the group consisting of polyester, polyvinyl chloride and polypropylene; and an adhesive layer provided over substantially said entire lower surface of said pocket for adhesively mounting said pocket to the substrate, said adhesive layer consisting essentially of an adhesive material which is thermoplastic, pressure sensitive adhesive with medium tack compound from paraffin wax and synthetic resins, wherein said adhesive material initially has a viscosity at 350 degrees F. of approximately 10,000 cps., a specific gravity of about 0.95, and a minimum peel strength of 1 lb. and a minimum shear creep of 15 hours at 500 g load, wherein said adhesive layer initially forms a releasable bond to permit relocation and re-orientation for approximately 24 hours afer initial mounting of said pocket to the substrate without damage to either and, thereafter, forms a permanent between said pocket and the substrate.

2. The system of claim 1, wherein the display item is a photograph.

3. The system of claim 1, further including a stiffening insert provided between said upper display surface and said opposed lower surface.

4. The system of claim 3, wherein said stiffening insert is selected from the group consisting of paper, cardboard, and bristol board.

5. The system of claim 1, wherein said upper display surface is transparent.

6. The system of claim 1, wherein said material is biaxially oriented polypropylene.

7. An album for displaying at least one flat, display item, said album including:

at least one page for mounting said at least one display item; and at least one one-piece pocket, each one-piece pocket being formed from a single sheet of transparent film material and folded to define an upper display surface for permitting viewing of said display item while protecting same and an opposed lower surface, said one-piece pocket being open along at least one side edge thereof to permit inspection and complete enveloping of said display item between said opposed upper and lower surface, said film material selected from the group consisting of polyester, polyvinyl chloride and polypropylene; and an adhesive layer provided over substantially said entire lower surface of said pocket for adhesively mounting said pocket to said at least one page by said adhesive layer, said adhesive layer consisting essentially of an adhesive material which is a thermoplastic, pressure sensitive adhesive with medium tack compounded from paraffin wax and synthetic resins, wherein said adhesive material initially has a viscosity at 350 degrees F. of approximately 10,000 cps., a specific gravity of about 0.95, and a minimum peel strength of 1 lb. and a minimum shear creep of 15 hours at 500 g load, wherein said adhesive initially forms a releasable bond to permit relocation and re-orientation for approximately 24 hours after initial mounting of said pocket to said at least one page without damage to either and, thereafter, forms a permanent bond between said pocket and said at least one page.

8. The album of claim 7, wherein said display items are photographs.

9. The album of claim 7, wherein the upper display surface is transparent.

10. The album of claim 7, wherein said material is biaxially oriented polypropylene.

11. A method for manufacturing a plurality of one-piece pockets for use in mounting flat, display items on a substrate, said method comprising the steps of:

(a) providing a continuous web of transparent material selected from the group consisting of polyester, polyvinyl chloride and polypropylene;
(b) applying a continuous line of permanent adhesive material to said web;
(c) folding said web of transparent material along an upper fold line;
(d) passing said web of transparent material through a first film edge heat and iron stand where the upper fold line is heated and ironed smooth;
(e) folding said web of transparent material again along a lower fold line;
(f) passing said web of transparent material through a second film edge heat and iron stand where the lower fold line is heated and ironed smooth to form a sleeve of said web of transparent material;
(g) sealing the sleeve along the continuous line of permanent adhesive material;
(h) laminating a web of release paper coated with a second adhesive to one surface of the sleeve, wherein said second adhesive is a thermoplastic, pressure sensitive, medium tack adhesive compounded from paraffin wax and synthetic resins and initially has a viscosity at 350 degrees F. of approximately 10,000 cps., a specific gravity of about 0.95, a minimum peel strength of 1 lb. and a minimum shear creep of 15 hours at 500 g load; and
(i) cutting the laminated sleeve in predetermined locations to form the plurality of one-piece pockets.

12. The method of claim 11, further including before step (b) the step of first creasing the continuous web of transparent material along the upper and lower fold lines with heated creasing rolls to cause a permanent crease score to be formed prior to folding the web to form the continuous sleeve.

13. The method of claim 11, wherein said thermoplastic, pressure sensitive, medium tack adhesive is applied to the web of release paper at a transfer coating station.

* * * * *